US006583734B2

(12) United States Patent
Bates et al.

(10) Patent No.: US 6,583,734 B2
(45) Date of Patent: Jun. 24, 2003

(54) ENHANCED VEHICLE HAZARD WARNING AND SAFETY FEATURES INTEGRATED WITH AN ONBOARD NAVIGATION SYSTEM

(75) Inventors: Cary Lee Bates, Rochester, MN (US); Robert James Crenshaw, Apex, NC (US); Paul Reuben Day, Rochester, MN (US); John Matthew Santosuosso, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 77 days.

(21) Appl. No.: 09/908,354

(22) Filed: Jul. 18, 2001

(65) Prior Publication Data

US 2003/0016146 A1 Jan. 23, 2003

(51) Int. Cl.[7] ..... G08G 1/123

(52) U.S. Cl. ..... 340/988; 340/905; 340/995.13; 342/357.07; 342/457; 701/213

(58) Field of Search ..... 340/905, 995, 340/988, 993, 990, 466, 539, 995.13; 701/213, 207, 208, 211, 300, 301; 342/457, 357.06, 357.07, 357.08

(56) References Cited

U.S. PATENT DOCUMENTS

| | | | | |
|---|---|---|---|---|
| 3,771,122 A | | 11/1973 | Sattler | |
| 4,357,594 A | | 11/1982 | Ehrlich et al. | |
| 4,807,101 A | | 2/1989 | Milde, Jr. | |
| 4,843,370 A | | 6/1989 | Milde, Jr. | |
| 5,223,844 A | * | 6/1993 | Mansell et al. | 342/357 |
| 5,289,181 A | | 2/1994 | Watanabe et al. | |
| 5,311,197 A | * | 5/1994 | Sorden et al. | 342/457 |
| 5,315,295 A | * | 5/1994 | Fujii | 340/936 |
| 5,334,974 A | * | 8/1994 | Simms et al. | 340/990 |
| 5,914,651 A | | 6/1999 | Smalls | |
| 5,948,040 A | | 9/1999 | DeLorme et al. | |
| 5,959,577 A | | 9/1999 | Fan et al. | |
| 6,014,595 A | * | 1/2000 | Kobayashi | 701/1 |
| 6,023,221 A | | 2/2000 | Michelotti | |
| 6,081,780 A | | 6/2000 | Lumelsky | |
| 6,133,855 A | * | 10/2000 | Kim | 340/932.2 |
| 6,351,211 B1 | * | 2/2002 | Bussard | 340/468 |
| 6,370,475 B1 | * | 4/2002 | Breed et al. | 701/301 |
| 6,407,698 B1 | * | 6/2002 | Ayed | 342/357.07 |
| 6,462,675 B1 | * | 10/2002 | Humphrey et al. | 340/905 |

* cited by examiner

*Primary Examiner*—Brent A. Swarthout
(74) *Attorney, Agent, or Firm*—Bracewell & Patterson LLP

(57) ABSTRACT

A method and system for vehicle hazard warning and safety integrated with an onboard navigational system for providing a current geographical location of the vehicle to a base station, receiving an event signal from the vehicle at the base station, while the vehicle is proximate to the current geographic location associating the geographic location with the event signal to determine that the vehicle is distressed, and transmitting hazard information from the base station to the vehicle in response to such association. The association may be based upon directional information which is provided by the vehicle. A control signal is transmitted to the vehicle and the hazard lights of the vehicle are automatically activated in response to receipt of that control signal. Navigational assistance can also be presented to the vehicle.

14 Claims, 3 Drawing Sheets

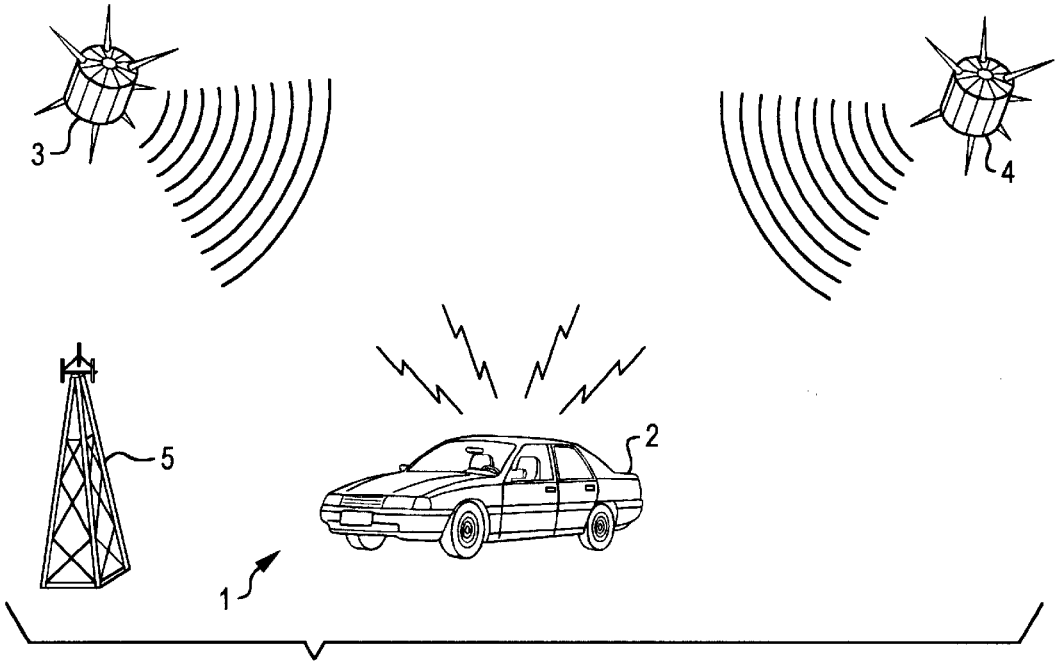
Fig. 1
Prior Art
Fig. 3
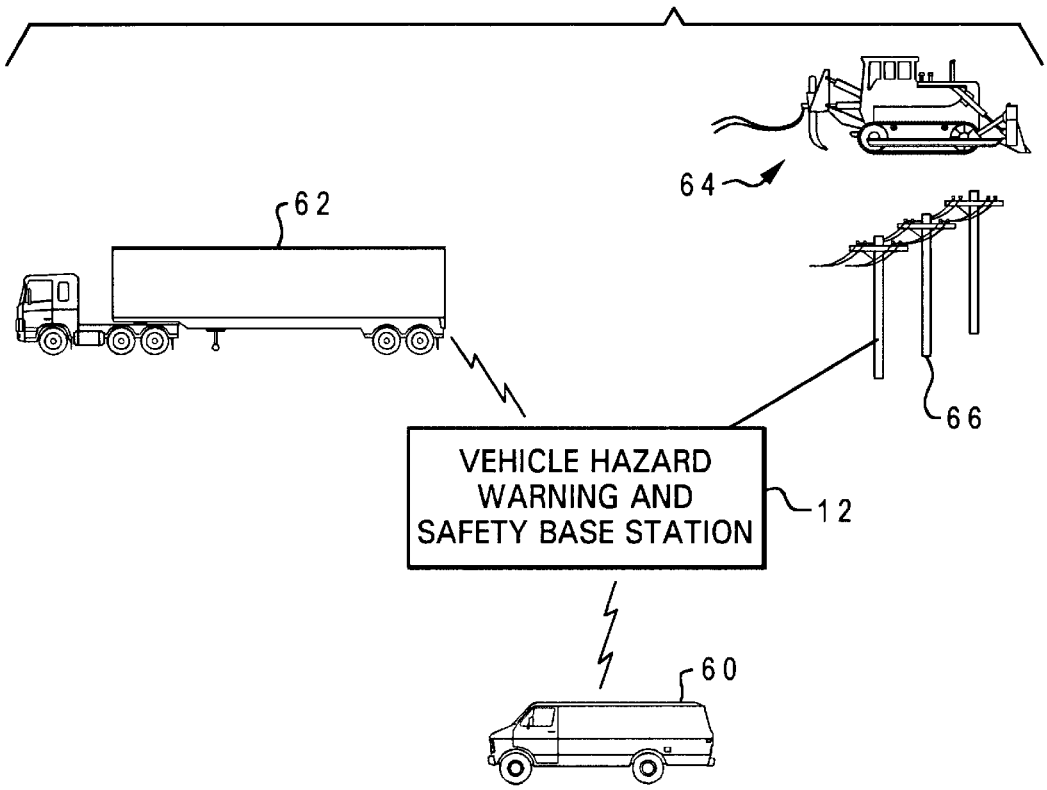

ENHANCED VEHICLE HAZARD WARNING AND SAFETY FEATURES INTEGRATED WITH AN ONBOARD NAVIGATION SYSTEM

BACKGROUND OF THE INVENTION

1. Technical Field

The present invention generally relates to computerized systems for use with highway vehicles, and more particularly to a method of enhancing the safety of such vehicles using an onboard navigation system and various databases.

2. Description of the Related Art

Various navigational aides have been devised for use in vehicles such as cars and trucks. One of the simplest navigational aides is a compass, and for many years cars have been equipped with either mechanical or electrical compasses to provide directional (heading) information. A more recent advance in this area is the use of the global positioning system (GPS) to locate a vehicle or mobile user.

As shown in FIG. 1, the GPS system 1 includes a vehicle 2 equipped with a GPS receiver, and a multitude of satellites, such as satellites 3 and 4. Satellites 3 and 4 send encoded signals via radio waves which are used by the GPS receiver to calculate the receiver's current geographic coordinates (latitude and longitude). Civilian applications of GPS presently allow a user to determine his or her exact location anywhere on Earth to within a few inches.

GPS tools can be used to provide a standalone navigation solution for the vehicle, in combination with an onboard data processing system having mapping software. The GPS receiver provides the geographic coordinates of the vehicle to the onboard computer, and the mapping software determines which map is appropriate for use based on those coordinates. This map can then be displayed for the user on a video device, such as a cathode ray tube (CRT) or liquid crystal display (LCD) panel, mounted in the vehicle. When directional information is added, the driver's location and heading can be overlayed on the map to assist the driver in determining the proper course.

More advanced onboard navigation systems are available in many new cars (e.g., OnStar), and have also become common in rental cars (e.g., NeverLost). These systems provide additional security by allowing the driver (or passenger) to manually activate an alarm which sends a distress beacon to a central monitoring office, as indicated in FIG. 1 by receiver antenna 5. A service advisor at the central office can then communicate with the vehicle occupants, as well as determine the vehicle's location in order to send out any assistance that might be necessary, such as a tow truck or policeman.

Some of these onboard systems are further programmed to respond to a distress situation automatically, such as when a vehicle's air bag is deployed (presumably caused by a traffic accident involving the vehicle). These systems not only advise the central office of such an event, but further automatically turn on the vehicle's blinking hazard lights.

While such systems are helpful in rendering aid to a distressed driver, they do little to immediately enhance the driver's safety, or to assist the driver in navigating the vehicle to a safe spot. Moreover, the vast majority of situations where the hazard lights should be turned on, or other assistance provided, do not involve an air bag deploying or any other cognizable event occurring. One of the most dangerous situations for accidents on busy highways is a vehicle which is stopped or stalled on the road. Even on divided highways or freeways, where the driver may think he or she has enough room to be safely out of the way of passing vehicles, there is still a great potential for real danger, particularly if the driver is not seen. These circumstances may be aggravated by conditions such as fog, snow, darkness, curves, etc. Yet it is precisely in these situations where drivers often fail to turn on their hazard lights or pursue other measures to ensure their own safety.

In light of the foregoing, it would be desirable to devise a hazard warning and safety system which could enhance existing navigational aides. Such a system would not only serve to reduce the number of accidents and related damage and injuries, but could also reduce other expenses, e.g., insurance, for commercial enterprises such as rental car companies. It would be additionally advantageous if the system could automatically detect hazardous situations even when no specific event has occurred, such as air bag deployment, and further automatically present helpful information to the driver.

SUMMARY OF THE INVENTION

It is therefore one object of the present invention to provide an improved navigational aide for mobile users.

It is another object of the present invention to provide an enhanced vehicle hazard warning and safety system which is integrated with an onboard navigation system.

It is yet another object of the present invention to provide such an enhanced system wherein hazardous or distress situations may be automatically detected and appropriate assistance immediately provided to the vehicle operator.

The foregoing objects are achieved in a method of enhancing the safety of a vehicle, generally comprising the steps of providing a current geographic location of the vehicle to a base station, receiving an event signal from the vehicle at the base station, while the vehicle is proximate the current geographic location associating the geographic location with the event signal to determine that the vehicle is distressed, and transmitting hazard information from the base station to the vehicle in response to said associating step. The associating step may be based upon directional information that is provided by the vehicle. The transmitting step transmits a control signal to the vehicle, the vehicle automatically activating hazard lights in response to receipt of the control signal. Navigational assistance information can also be presented to the vehicle.

The above as well as additional objectives, features, and advantages of the present invention will become apparent in the following detailed written description.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

FIG. 1 is a pictorial representation of a conventional vehicle navigation system which utilizes the global position system (GPS);

FIG. 3 is a pictorial representation of an exemplary implementation of the vehicle hazard warning and safety system of the present invention.

DETAILED DESCRIPTION OF THE PREFERRED EMBODIMENT

Figure 2:
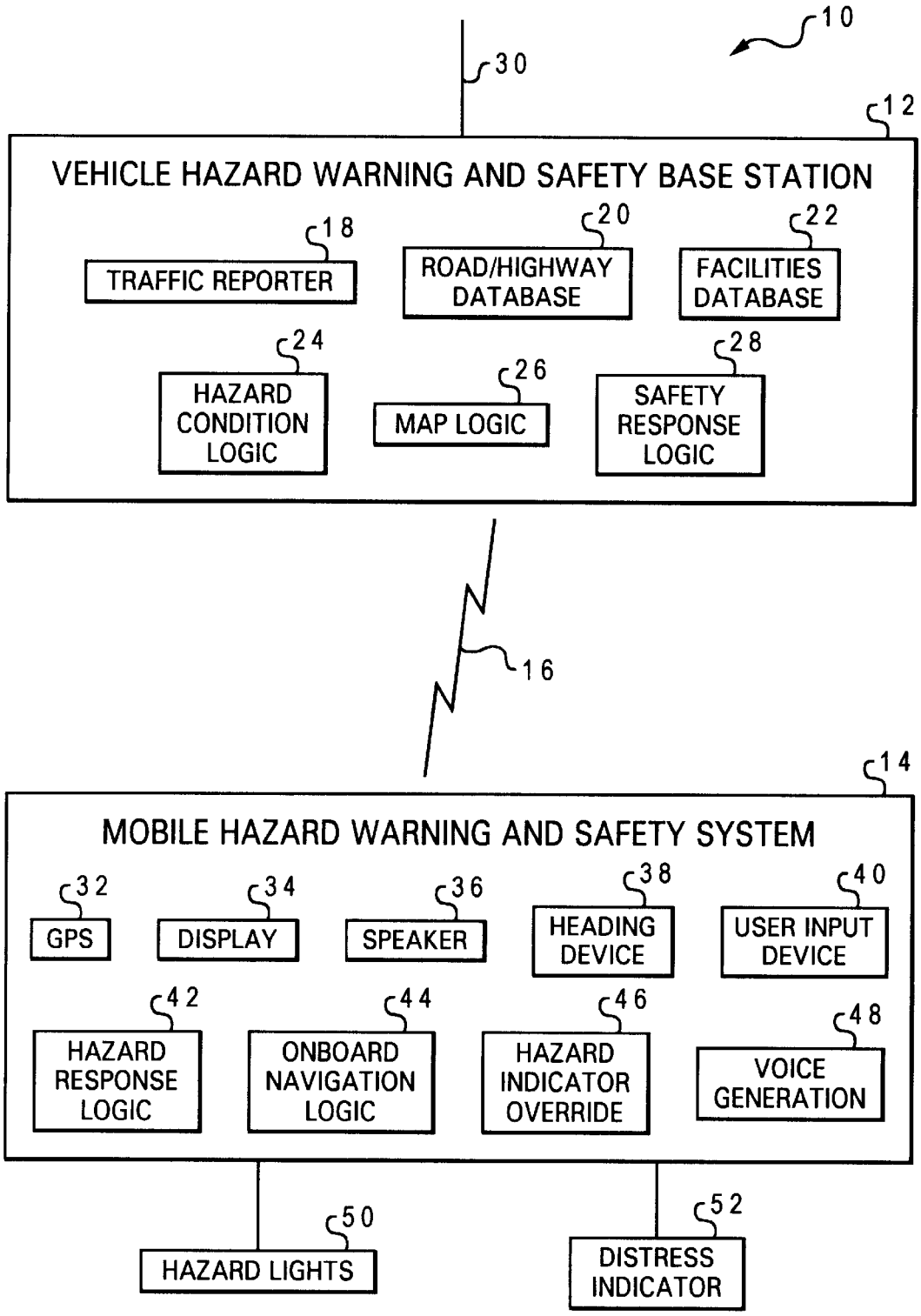
FIG. 2 is a high-level block diagram illustrating one embodiment of the vehicle hazard warning and safety system of the present invention.

With reference now to the figures, and in particular with reference to FIG. 2, there is depicted one embodiment 10 of a vehicle hazard warning and safety system constructed in accordance with the present invention. Vehicle hazard warning and safety system 10 is generally comprised of a vehicle hazard warning and safety base station 12, and a mobile hazard warning and safety system 14, which communicate by conventional wireless technology as indicated at 16.

In the depicted embodiment, vehicle hazard warning and safety base station 12 includes a traffic reporter 18, a road/highway database 20, a facilities database 22, hazard condition logic 24, map logic 26, and safety response logic 28. Vehicle hazard warning and safety base station 12 may be connected to other services via a communications line 30.

Mobile hazard warning and safety system 14 includes a global positioning system (GPS) receiver 32, a display device 34 such as a cathode ray tube (CRT) or liquid crystal display (LCD) panel, a speaker 36, a directional or heading instrument 38 (such as an electronic compass), a user input device 40 (such as a keyboard or touch-screen), hazard response logic 42, onboard navigation logic 44, a hazard indicator override 46, and voice generation 48. Mobile hazard warning and safety system 14 has a two-way connection to the vehicle's hazard lights 50, which allows system 14 to turn the hazard lights on, and which further allows system 14 to determine when the driver has manually activated hazard lights 50. Mobile hazard warning and safety system 14 may also be operatively connected to a distress indicator 52, such as an air bag alarm signal which is activated when the vehicles air bag is deployed. System 14 may receive inputs from other features of the vehicle, such as the transmission gear selector, the parking brake, and the engine electrical power system.

While the navigational subsystem for the present invention preferably utilizes GPS technology which relies on earth-orbiting satellites, those skilled in the art will appreciate that other navigational aids besides GPS can be used, such as a triangulation system using land-based antennas.

The present invention utilizes the navigational subsystem to automatically determine when a distress situation arises with the vehicle. For example, if the vehicle transmission is put in the "Park" gear, or the parking brake set, or the engine is turned off, and the GPS subsystem determines that the vehicle is still on a major highway, then a distress situation would be indicated. System 10 then provides automatic responses to this indication, such as turning on hazards lights 50, or providing selected information to the vehicle operator.

Using information provided by GPS 32 and directional device 38, the onboard computer can determine that the vehicle has stopped at the side of or on a busy highway, for example, verifying that the stopped vehicle has been tracking to a particular highway segment for some threshold distance, and that the vehicle has remained oriented within some angle, say 20°, of the highway's orientation for some threshold distance. If these conditions are met and the driver puts the vehicle in "Park," sets the parking brake, or turns off the engine, then the hazard lights are deployed. Orientation is not always necessary, but its use is preferable since it may indicate that the vehicle is no longer on the highway, e.g., where the driver pulls off the road into a nearby parking lot and the orientation of the vehicle has changed.

In the case of divided or controlled-access highways, it is unlikely that system 10 would provide a faulty indication of a distress situation but, in the event that the operator desires to limit application of the invention, means are provided to allow this at the driver's option. For example, on busy two-lane highways where access is not restricted, there may be occurrences where there is a favorite stop that does not involve a large change in orientation of the vehicle and is close enough to the road to confuse system 10 into deploying. The driver could therefore update the navigation system's map data to record any common locations that might be visited, which would otherwise activate the hazard lights. In this manner, when the vehicle is within say 50 yards of that location, the hazard lights will not be automatically activated. This deactivation of the invention would be as simple as pressing a button (hazard indicator override 46) when at that problem location.

Map data could also be augmented with areas for which the hazard lights are not to be automatically deployed, e.g., rest stops, scenic views, and exits. If there is a rest stop or scenic pull-over where automobiles may violate the other constraints for deploying the hazard lights, then by using this additional map data, the system would prevent itself from misfiring.

Optionally, if the vehicle comes to a sudden stop in an area that is on a divided highway, and GPS information indicates that the vehicle is clearly away from any exits and oriented in the direction of the highway, then the system can activate the hazard lights for a short period of time or until the vehicle starts moving again. This option will warn other vehicles who are coming from behind and who may thus be forced to make a quick stop. In any case, the driver can still turn the hazard lights on or off manually.

In a further aspect of the present invention, as shown in FIG. 3, when the hazard lights on the distressed vehicle 60 are activated (manually or automatically), a radio beacon message is sent to other vehicles 62 with onboard navigation systems that are approaching the vicinity, to give them ample warning about the stopped vehicle and its relative location. The GPS location of the originator is part of the beacon message, so the vicinity distance can be made variable, depending on such things as terrain, or urban versus rural areas. To cover the case where a vehicle is stopped on a divided highway, additional directional information may be included with the beacon message, so that only the vehicles traveling in the same direction would need to display the warning.

When the hazard lights are activated (manually or automatically), mobile hazard warning and safety system 14 informs the driver of important information relative to the stopped location. This information is automatically retrieved and presented to the user via display device 34, or via 36 using voice generation 48. This information is preferably encoded with the map data and may include: nearness of on/off ramps, which are an increased potential for accidents when a vehicle is stopped on the shoulder nearby; nearness of a gas station or rest stop, so the driver knows the best direction to go for help, or determine a better/safer place to park the vehicle; warnings of other hazards, such as a section of highway with a narrow shoulder, or when the vehicle is stopped on a corner, or on a long down hill grade where trucks may have trouble slowing down; and, for trucks and other commercial vehicles, the driver could be advised of additional safety measures that are required by state or local traffic laws (e.g., exactly how and where to deploy safety signs and/or flare behind the vehicle). Highway traffic information, e.g., slowed traffic, can be collected by traffic reporter 18 and that information supplied as well. Other information may be provided, such as construction 64 (FIG. 3) which is reported to system 12 via land lines 66.

This information is automatically presented to the operator by the onboard navigation system when the hazard lights are activated, and is not dependent on the operator explicitly requesting the information. The automatic presentation of such information can be the deciding factor and margin of safety in preventing accidents, reducing property damage, and saving lives.

Figure 4:
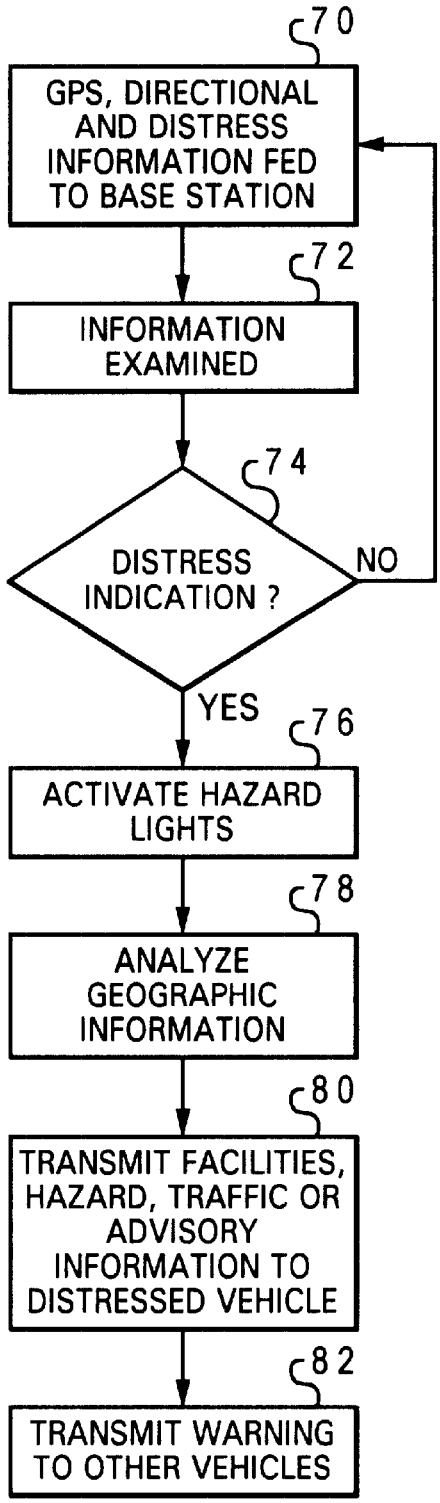
FIG. 4 is a chart illustrating the logical flow according to one method for carrying out the present invention.

The present invention may be further understood with reference to the flow chart of FIG. 4. In this exemplary implementation, the process begins with the transmission of GPS information, directional information, and distress information to the base station (70). The information is examined by the agent at the base station (72), and a determination is made as to whether a distress situation is indicated (74). If not, the process iterates to step 70. If a distress situation is indicated, a signal is sent to activate the hazard lights on the vehicle (76). The geographic information transmitted to the base station is further analyzed by the agent to determine which databases should be consulted regarding nearby facilities, hazards or other driving conditions (78). Any such relevant information is then transmitted to the distressed vehicle (80). Warnings may optionally be sent to other vehicles which are nearby or traveling on the same highway (82).

Although the invention has been described with reference to specific embodiments, this description is not meant to be construed in a limiting sense. Various modifications of the disclosed embodiments, as well as alternative embodiments of the invention, will become apparent to persons skilled in the art upon reference to the description of the invention. It is therefore contemplated that such modifications can be made without departing from the spirit or scope of the present invention as defined in the appended claims.

What is claimed is:

1. A method for providing hazard warning to a driver of a vehicle, said method comprising:

in response to an immobilization of said vehicle, automatically determining if said vehicle is situated on a highway;

in a determination that said vehicle is situated on a highway, automatically activating hazard lights of said vehicle;

in response to said activation of hazard lights of said vehicle, automatically retrieving information related to a location at which said vehicle is stopped; and automatically presenting said retrieved information to said driver within said vehicle.

2. The method of claim 1, further comprising transmitting location information of said vehicle via a radio beacon message to warn other vehicles in the vicinity of said vehicle.

3. The method of claim 1, wherein said automatically determining further includes automatically determining if said vehicle is situated on a highway via a global positioning system.

4. The method of claim 3, further comprising confirming said vehicle is situated on a highway by determining if said vehicle is oriented within a predetermined angle of said highway's orientation.

5. The method of claim 1, wherein said automatically presenting further includes automatically displaying said retrieved information to said driver within said vehicle.

6. The method of claim 1, further comprising transmitting an event signal by said vehicle to a base station in response to a deployment of a safety feature of said vehicle.

7. The method of claim 1, further comprising overriding said activation of hazard lights by said driver.

8. A system for providing hazard warning to a driver of a vehicle, said system comprising:

means for automatically determining if said vehicle is situated on a highway, in response to an immobilization of said vehicle;

means for automatically activating hazard lights of said vehicle, in a determination that said vehicle is situated on a highway;

means for automatically retrieving information related to a location at which said vehicle is stopped, in response to said activation of hazard lights of said vehicle; and means for automatically presenting said retrieved information to said driver within said vehicle.

9. The system of claim 8, further comprising means for transmitting location information of said vehicle via a radio beacon message to warn other vehicles in the vicinity of said vehicle.

10. The system of claim 8, wherein said means for automatically determining further includes a global positioning system for automatically determining if said vehicle is situated on a highway.

11. The system of claim 10, further comprising means for confirming said vehicle is situated on a highway by determining if said vehicle is oriented within a predetermined angle of said highway's orientation.

12. The system of claim 8, wherein said means for automatically presenting further includes a display for automatically displaying said retrieved information to said driver within said vehicle.

13. The system of claim 8, further comprising means for transmitting an event signal by said vehicle to a base station in response to a deployment of a safety feature of said vehicle.

14. The system of claim 8, further comprising means for overriding said activation of hazard lights by said driver.

* * * * *